United States Patent [19]

Fraser et al.

[11] Patent Number: 4,975,811

[45] Date of Patent: Dec. 4, 1990

[54] METHOD AND APPARATUS FOR ILLUMINATION OF A LIQUID DROPLET FOUNTAIN TO PRODUCE RAINBOWS

[76] Inventors: Alistair B. Fraser, P.O. Box 378, Lemont, Pa. 16851; Ripley Golovin, 26 E. 91st St., New York, N.Y. 10128

[21] Appl. No.: 412,311

[22] Filed: Sep. 26, 1989

[51] Int. Cl.[5] ..... F21V 33/00

[52] U.S. Cl. ..... 362/96; 362/318; 362/806

[58] Field of Search ..... 362/96, 101, 318, 806

[56] References Cited

U.S. PATENT DOCUMENTS

| | | | |
|---|---|---|---|
| 2,572,379 | 10/1951 | Pearse | 362/96 |
| 2,726,116 | 12/1955 | Barber | 362/96 |
| 3,162,367 | 12/1964 | Nowack | 362/96 |
| 3,334,816 | 8/1967 | Mizuno | 362/96 |
| 3,567,075 | 3/1971 | Neri | 222/129.4 |
| 4,002,333 | 7/1977 | Gotoh | 272/8 D |
| 4,109,399 | 8/1978 | Ivancevich | 35/26 |
| 4,395,835 | 8/1983 | Schneider | 40/406 |
| 4,557,055 | 12/1985 | Arai | 353/81 |
| 4,661,893 | 4/1987 | Robinson et al. | 362/318 |
| 4,681,402 | 7/1987 | Tiffany | 350/286 |
| 4,743,477 | 5/1988 | Beaver | 428/13 |
| 4,765,724 | 8/1988 | Huichun | 350/18 |
| 4,783,133 | 11/1988 | Chen | 350/376 |
| 4,849,866 | 7/1989 | Mori | 362/327 |

FOREIGN PATENT DOCUMENTS

| | | | |
|---|---|---|---|
| 61-198209 | 9/1986 | Japan | 362/96 |

*Primary Examiner*—Ira S. Lazarus
*Assistant Examiner*—Richard R. Cole
*Attorney, Agent, or Firm*—Howrey & Simon

[57] ABSTRACT

A method and apparatus for producing primary rainbows and secondary rainbows in a curtain of liquid droplets in the air, whereby the rainbows are produced by refractive dispersion within the droplets themselves, and whereby the rainbows are visible from directly opposite sides of the curtain of droplets. The curtain of liquid droplets is produced by a water fountain. The device of the invention comprises a source of radially distributed light and a source of liquid droplets. The light source can be an array of lights configured so that the light rays appear to emanate from a common center. The light source may also be a collimated light source such as a searchlight which reflects light off a mirror-like conical surface or a combination of such sources. The light source may also be a single light source in a covered curved reflector.

18 Claims, 5 Drawing Sheets

METHOD AND APPARATUS FOR ILLUMINATION OF A LIQUID DROPLET FOUNTAIN TO PRODUCE RAINBOWS

BACKGROUND OF THE INVENTION

1. Field of Invention

The present invention relates to a method to illuminate a curtain of liquid droplets so that natural primary and secondary rainbows can be observed continuously from opposite sides of the droplet curtain.

2. Description of the Prior Art

The prior art has not attempted to facilitate the production of actual rainbows through a curtain of liquid droplets as might be provided by means of a water fountain. Rather, the prior art has attempted to simulate rainbows by entirely different optical processes, such as by using colors produced by absorption rather than refractive dispersion. The reasons for both the difficulties experienced by prior art and its resulting compromises are more easily understood after an explanation as to the manner in which rainbows are produced in nature. Against this background, the solution to the problem of artificial rainbow production provided by the present invention stands in stark contrast to the efforts of prior art.

Rainbows are produced in nature when nearly parallel beams of light from either the sun or the moon are scattered by the nearly spherical droplets of water in a rain shower, spray from a waterfall, or an artificial source of water droplets such as provided by a water fountain. The position of each rainbow is at a fixed angular distance from the light source: approximately 138 degrees for the primary rainbow and approximately 129 degrees for the secondary rainbow. As a consequence, the resulting rainbow can only be seen from one side of the shower or fountain. If, for example, an observer to the west of the shower can see a rainbow in the shower, an observer to the east of that shower cannot see the rainbow. Another consequence is that as the sun, or moon, moves across the sky, the position of each rainbow moves with it. Further, rainbows may not be visible if the sun or moon are high in the sky, such as is the case in midday in the mid-latitudes.

Because the object of the present invention is to enable a rainbow to be viewed continuously in a curtain of water droplets, the explanation of rainbow production herein will be confined to the behavior of rainbows in such curtains. For convenience, references to the sun will be taken to mean either the sun or the moon.

The observation of natural rainbows in a curtain of water droplet depends on the natural occurrence of many factors. Often, a rainbow cannot be observed as a result of cloudy or foggy conditions. In such conditions, the requisite parallel light from the sun has been replaced with ineffective diffuse light from the clouds. Even when the sun is out, it is often not in the proper position to enable an observer to see either a primary or secondary rainbow. On the few occasions when a rainbow can be observed, its position in the fountain and the portion of the rainbow which can be observed is variable even for a fixed observer.

The most obvious solution to the problem of rainbow production would appear to be to provide a substitute sun—a fixed source of essentially parallel light which would illuminate the fountain. However, such a solution would require, at one extreme, a bank of collimated lights with an area roughly as large as that of one face of the curtain of droplets itself, or, at the other extreme, a single powerful collimated light placed at a great distance from the curtain and having a comparable brightness and angular size (as observed from the curtain) as the sun. Neither solution lends itself practically or aesthetically to the construction of a rainbow fountain for viewing by the public. In addition to the ungainly size of the facilities required by both solutions, the fact that an observer would be required to stare directly into these brilliant lights if he were to turn his back to the fountain eliminates such solutions for practical use with the public.

Several prior art efforts have been attempted to address the problem for artificial rainbow production. U.S. Pat. No. 4,681,402 to Carlton R. Tiffany discloses a rainbow projector. The Tiffany patent discloses a method by which an arc of colors resembling a natural rainbow can be projected upon a screen by using a curved prism. As Tiffany's screen might conceivably be a curtain of water droplets such as obtained from a water fountain, the Tiffany device might provide a rainbow-like appearance upon the fountain. Similarly, U.S. Pat. No. 4,557,055 to Akira Arai discloses a rainbow projector, based upon a series of prisms and lenses, which conceivably might be used to project an arc of rainbow-like colors upon a curtain of water droplets, although Arai's intent was to use a more conventional surface such as a room wall. However, neither inventions, even if used with a fountain, would produce real rainbows as the colors are produced by an external device and merely projected to a display medium, such as a screen, rather than having the colors being produced by refractive dispersion within the water droplets themselves.

U.S. Pat. No. 4,002,333 to Hideyuki Gotoh discloses a rainbow phenomenon developing device. The Gotoh patent discloses a device by which a wall of falling water droplets is illuminated by colored panels which are arranged to provide a rainbow-like appearance. The result, however, is not a rainbow, as the colors were produced by absorption in the panels rather than being produced by refractive dispersion within the water droplets themselves.

SUMMARY OF THE INVENTION

The present invention consists of a liquid source which provides a curtain of liquid droplets that is illuminated radially by a fan of light from some point within or nearly within the droplet curtain. The best or preferred location of the radial light source is at the center bottom of the droplet fountain. However, the invention will operate effectively with the light source at other locations within the fountain as long as the fountain is illuminated by a radial pattern of light. The preferred liquid for the fountain is water. However, a wide variety of liquids could be used.

The rainbow fountain of the present invention consists of a row, or series of rows, of spigots with adjustable nozzles which provide a curtain of water droplets. At the bottom center of the fountain is illumination equipment which directs a fan of light through the curtain of water droplets. In one embodiment of the invention, the fan of light is directed through the fountain by one or two half-cone mirrors at half-angles of 45 degrees. The mirrors are illuminated by a source of collimated light such as a searchlight so that the fan of light emanates from the cone to illuminate the curtain of water droplets. In another embodiment of the invention, multiple light sources are radially mounted on an 180° arc under the fountain. In a third embodiment, a single light source is mounted under a covered concave reflector to illuminate the droplets. In all the embodiments, the center of the radial light pattern is preferably located in the lower center of the curtain of water droplets.

The uniform distribution and dispersion of the water droplets in the fountain and the relatively uniform droplet size is achieved through the use of fine water particle spray nozzles. The nozzles are in fluid communication with a water source positioned on the ground. The water spray pattern through the nozzles may be made uniform or varied depending on the rainbow effect to be achieved. The water used in the water particle spray nozzles can be obtained from a water service, pond, lake, river, sea or other water reservoir. A pumping unit may be used so that a high percentage of the water can be recycled. Flow rate and droplet size are varied to modify the brightness and appearance of the resulting rainbows.

For an observer standing on either side of the fountain, two rainbows will appear in the fountain. The primary rainbow will have an angular radius of 48 degrees and the secondary rainbow will have an angular radius of 39 degrees. In contrast to rainbows produced by a parallel light source, such as the sun, the primary and secondary rainbows will be seen in reversed order. Nevertheless, they retain the conventional color order of solar rainbows in that red appears to the outside of the inner rainbow, and to the inside of the outer rainbow.

The angular radius recited herein are based upon the assumption that the observer was standing back from the center of the fountain and, thus, the center of the light source. As the observer moves to the left or right of this position, the angular size of each rainbow increases somewhat.

As the center of the radial light is embedded in the fountain and the light only illuminates the fountain itself, there is no danger of observers being exposed to a blinding source of light.

Experience to date demonstrates that to achieve a good rainbow any uniform radial light source supplied as explained herein will operate effectively. However, we have developed at least six different structures for achieving a radial source of light for the fountain. Four techniques use a reflecting cone, or portion thereof, which is illuminated from the apex end by a source of parallel light. In this embodiment, the light source is a searchlight using a standard parabolic reflector. Our experience demonstrates that this will produce the requisite pattern of radial illumination. The conical reflector and the searchlight can be combined into one unit and embedded in the fountain. Such units may be further combined back to back on opposite sides of the fountain. This dual light source arrangement reduces the dimensions of the cones and searchlights by a factor of two and makes them less obtrusive.

DETAILED DESCRIPTION OF PREFERRED EMBODIMENTS

Figure 1:
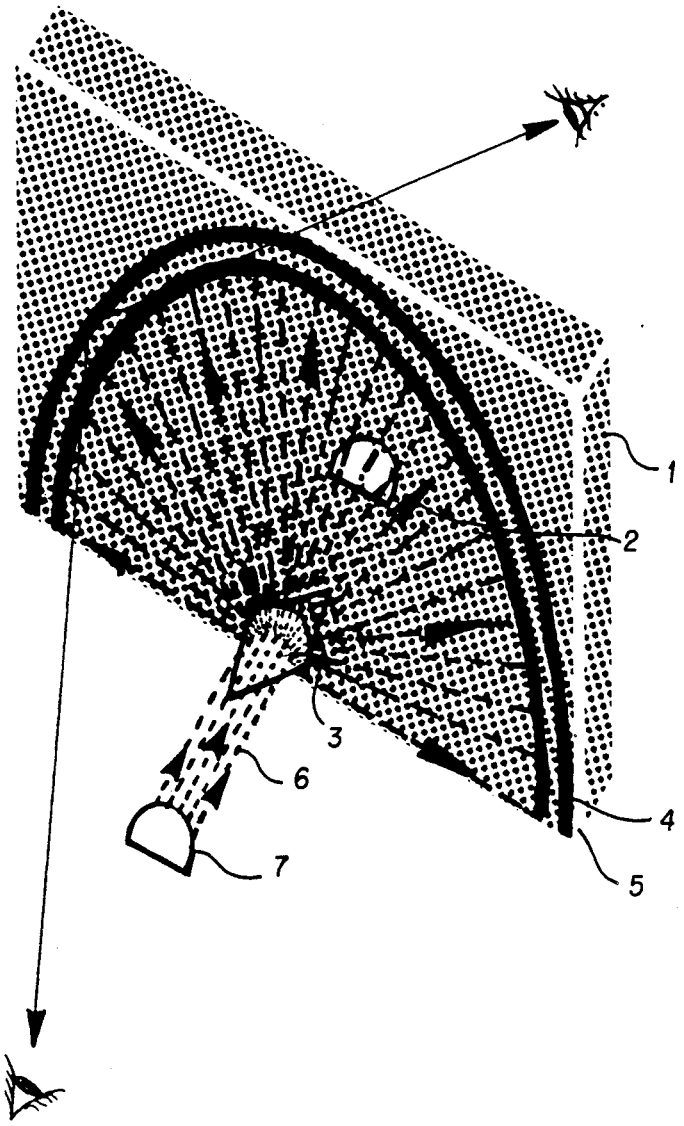
FIG. 1 is a perspective view of one embodiment of a rainbow fountain of the present invention.

FIG. 1 depicts one embodiment of the fountain in which the rainbow is created through a diaphanous wall 1 of water droplets. A radial pattern of illumination 2 is projected by reflector cone 3 to create a primary and a secondary rainbow. The water droplet source is a series of water nozzles 5.

Figure 2:
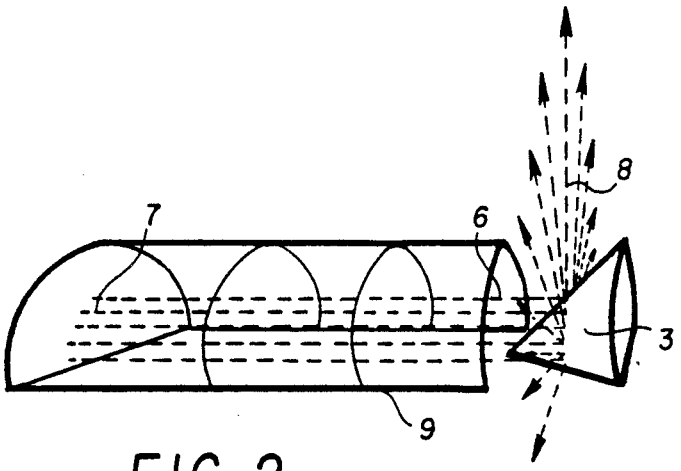
FIG. 2 is a side perspective view of the light source for producing the radial distribution of light by using a collimated light source and a reflecting cone.

The nozzles may be arranged in rows or series of rows. The water spray from the nozzles may be adjusted by spigots or the nozzle spray pattern may be preset. The reflector cone 3 is positioned at the bottom center of the fountain and illuminates the curtain of water droplets with a fan of light. The reflector cone is a half-cone element with a mirror-like finish with a half-angle of 45 degrees. As shown in FIG. 2, collimated light 6 from a searchlight 7 is directed to the cone 3. The path from the searchlight 7 to cone 3 may be covered with cover 9 to provide clear light path through the spray and to protect viewers from blinding light. In the FIG. 1 embodiment, the center of the radial light pattern 6 is located in the lower center of the curtain of water droplets. However, positioning the pattern at other locations will also produce adequate rainbows.

The water droplets are uniformly distributed across the light pattern and are relatively uniform in size. Fine water particle spray nozzles in fluid communication with a hydraulic source are used to create the fountain. The water employed in the water particle spray nozzles can be obtained from a water service, pond, lake, river, sea, or water reservoir. A pumping unit which provides proper water pressure can be arranged so that a high percentage of the water can be recycled. Flow rate and droplet size may be varied to modify the brightness and appearance of the rainbows. A white light source is used to create rainbows from the curtain. However, a monochromatic light source such as a laser may be used to create a single color bow.

As shown in FIG. 2, a uniform radial pattern 8 of illumination is projected from a searchlight source 7. The searchlight projects uniform collimated light 6, which is transformed into a uniform pattern of radial illumination 8, by conical reflector 3 with a half angle of about 45 degrees. The light source, 7, and a portion of the cone 3, have a cover 5, which prevents stray light from being seen by viewers of the rainbow and the spray from the fountain from interfering with the collimated light 6.

Figure 3:
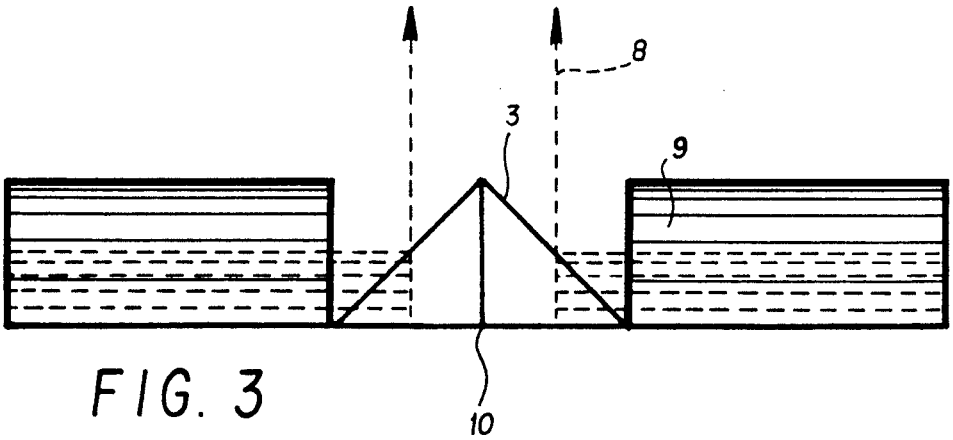
FIG. 3 is a side elevation view of light source for producing the radial distribution of light using two collimated light sources and two reflecting cones.

FIG. 3 shows another arrangement of the light source for providing the uniform radial pattern of illumination. In this arrangement, two reflector cones as shown in FIG. 2 are positioned in tandem. This is accomplished by having the bases 10 of the two cones face one another.

Figure 4:
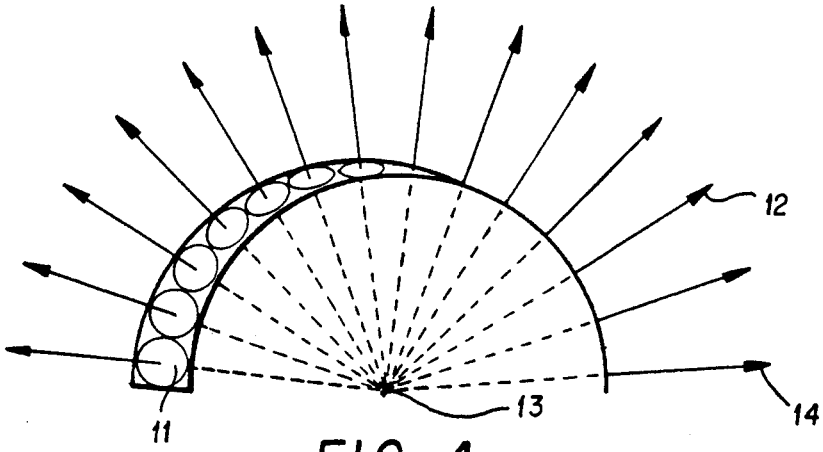
FIG. 4 is a perspective view of the light source for producing the radial distribution of light using a number of radially arranged separate light sources mounted under the fountain.

FIG. 4 depicts an alternative method of providing a uniform radial pattern of illumination. Light source 11 are embedded in an arc of 180° so that the light rays 12 emanate as from a common center 13 and also provide a uniform distribution of light 14.

Figure 5:
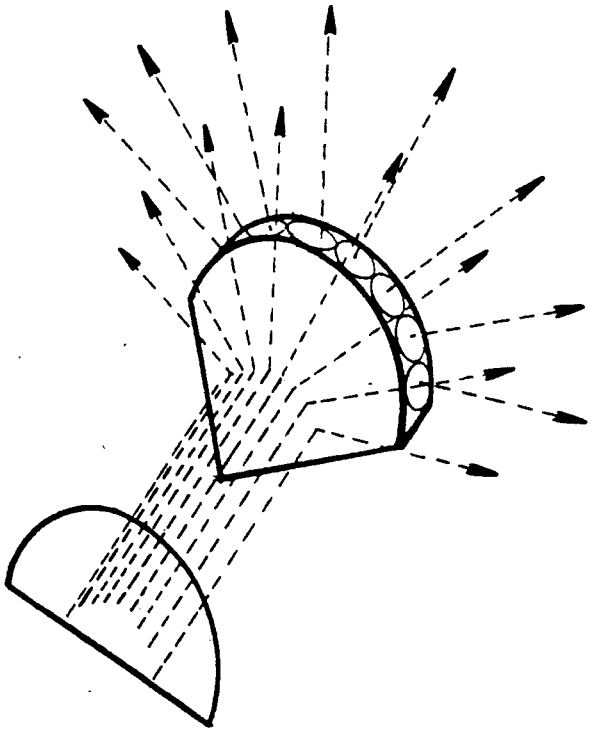
FIG. 5 is a perspective view of the light source for producing the radial distribution of light by using both radially mounted lights and a collimated light with a reflecting cone.

FIG. 5 depicts an alternative method of providing a uniform radial pattern of illumination in which the reflector illustrated in FIGS. 3 and the arc array illustrated in FIG. 4 are combined.

Figure 6:
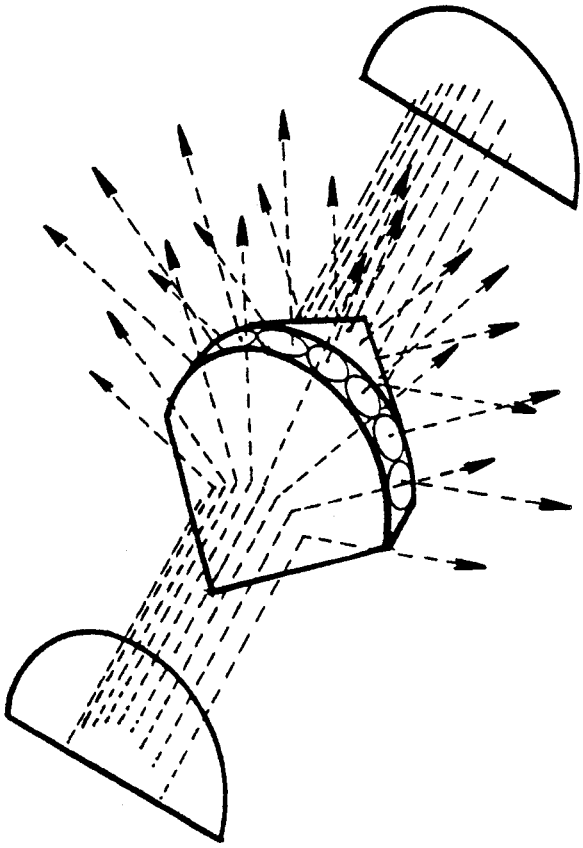
FIG. 6 is a perspective view of the light source for producing the radial distribution of light by using both radially mounted lights and a two collimated light sources with two reflecting cones.

FIG. 6 depicts an alternative method of providing a uniform radial pattern of illumination in which two composite source such as shown in FIG. 5 are combined.

Figure 7:
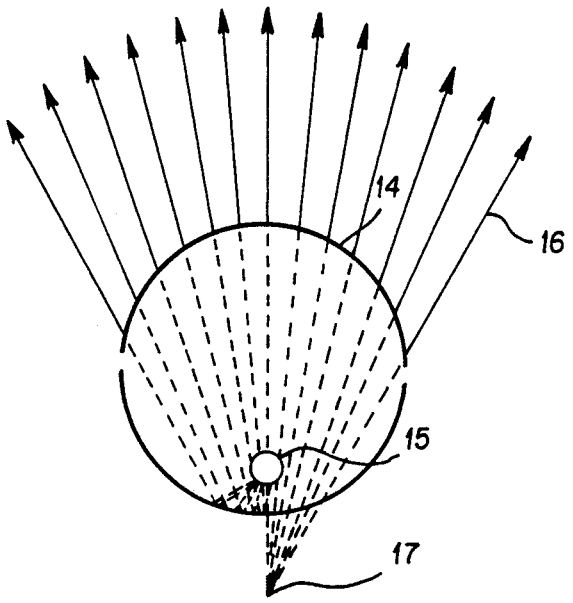
FIGS. 7 and 8 are a side elevation view and perspective view of an alternate light source for producing the radial distribution of light using a single white light and a covered concave mirror.
Figure 8:
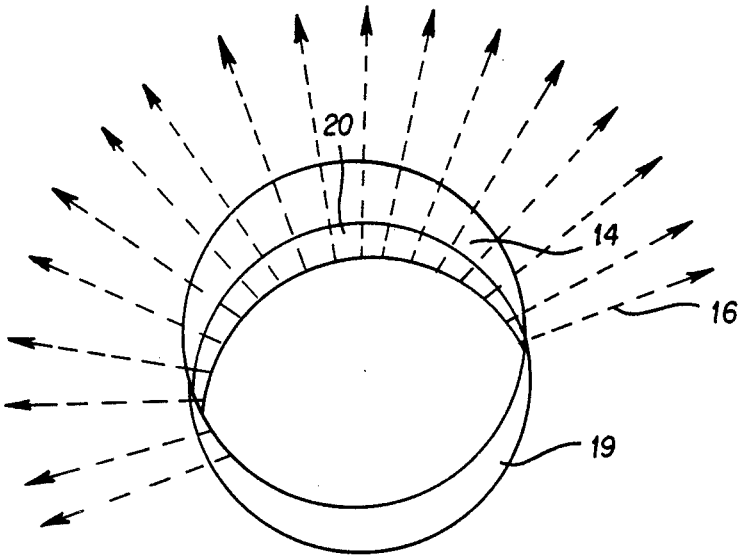

Another alternative is shown in FIGS. 7 and 8. In FIG. 8, a uniform radial pattern of illumination is created through an arc opening 20 in opaque cover 14. Light source 15 emits a uniform distribution of light rays 16. As shown in FIG. 7, the rays appear to emanate from a common center 17 because they are reflected by reflector 19. Light sources 15 and the reflected light from reflector 19 project a single radial pattern through opening 20 in opaque cover 14.

It will be understood by those skilled in the art that the present disclosure is not intended to limit the invention to those embodiments described. On the contrary, it is intended to cover all alternatives, modifications and equivalents as may be included within the spirit and scope of this invention.

The invention will be limited to solely by the claims.

What we claim is:

1. A means for creating primary and secondary rainbows in a curtain of liquid droplets, whereby the rainbows are produced by refractive dispersion in the liquid droplets themselves and can be seen from both sides of the curtain of liquid droplets, comprising nozzle means for creating a curtain of liquid droplets, a liquid source means for supplying liquid under pressure to said nozzle means, and a light directing means for providing a radial pattern of light to illuminate said curtain of liquid droplets, said light directing means being positioned within said curtain of liquid droplets.

2. A rainbow producing device as claimed in claim 1 where the directing means for the radial light pattern is a group of single light sources mounted in an arc so that the so that the light emanating from the directing means appears to emanate from a common center.

3. A rainbow producing device as claimed in claim 1 where the directing means for the radial light pattern is a collimated light source and a conical reflector.

4. A rainbow producing device as claimed in claim 1 where the directing means for the radial light pattern is a collimated light source and a conical reflector used in conjunction with one or more radially mounted lights.

5. A rainbow producing device as claimed in claims 3 or 4 wherein the light path between the collimated light source and the conical reflector is covered.

6. A rainbow producing device as claimed in claim 1 where the directing means for the radial light pattern is two collimated light sources and two conical reflectors having base portions mounted with the bases facing one another.

7. A rainbow producing device as claimed in claim 1 where the directing means for the radial light pattern is two collimated light sources and two conical reflectors used in conjunction with one or more radially mounted lights.

8. A rainbow producing device as claimed in claims 6 or 7 wherein the light path between at least one of the collimated light sources and at least one of the conical reflectors is covered.

9. A rainbow producing device as claimed in claim 1 where the directing means for the radial light pattern is a single light source positioned within a covered concave reflector.

10. A means for creating primary and secondary rainbows in a curtain of liquid droplets, whereby the rainbows are produced by refractive dispersion in the droplets themselves and can be seen from both sides of the curtain of droplets, comprising a light directing means for emitting a radial fan of light to illuminate the curtain of droplets, said light directing means being positioned substantially within the curtain of droplets and the emitted radial fan of light lying substantially within the plane of the curtain of droplets, nozzle means for creating a curtain of droplets which is illuminated by said radial light pattern, and a liquid source means for supplying liquid under pressure to said nozzle means.

11. A rainbow producing device as claimed in claim 10 where the directing means for the radial light pattern is a group of single light sources mounted in an arc so that the light emanating from said directing means appears to emanate from a common center.

12. A rainbow producing device as claimed in claim 10 where the directing means for the radial light pattern are a collimated light source and a conical reflector used in conjunction with a one or more radially mounted lights.

13. A rainbow producing device as claimed in claim 10 where the directing means for the radial light pattern is two collimated light sources and two conical reflectors used in conjunction with a one or more radially mounted lights.

14. A rainbow producing device as claimed in claim 10 where the directing means for the radial light pattern is a single light source positioned in a covered concave reflector.

15. A means for creating primary and secondary rainbows in a curtain of liquid droplets, whereby the rainbows are produced by refractive dispersion in the liquid droplets themselves and can be seen from both sides of the curtain of liquid droplets, comprising nozzle means for creating a curtain of liquid droplets, a liquid source means for supplying liquid under pressure to said nozzle means, and a light directing means for providing a radial pattern of light to illuminate said curtain of liquid droplets, said light directing being a collimated light source and a conical reflector.

16. A rainbow producing device as claimed in claim 15 further including a second collimated light source and a second conical reflector, said second reflector being positioned with respect to the first conical reflector so that the bases of the reflector cones face one another.

17. A means for creating primary and secondary rainbows in a curtain of liquid droplets, whereby the rainbows are produced by refractive dispersion in the droplets themselves and can be seen from both sides of the curtains of liquid droplets, comprising nozzle means for creating a curtain of liquid droplets, a liquid source means for supplying liquid under pressure to said nozzle means, and a light directing means for providing a radial pattern of light to illuminate said curtain of liquid droplets, said light directing means being positioned with respect to said curtain of liquid droplets so that said radial pattern of light is substantially coplanar with the plane of said curtain of liquid droplets.

18. A means for creating primary and secondary rainbows in a curtain of liquid droplets, whereby the rainbows are produced by refractive dispersion in the droplets themselves and can be seen from both sides of the curtain of liquid droplets, comprising nozzle means for creating a curtain of liquid droplets, a liquid source means for supplying liquid under pressure to said nozzle means, and a light directing means for providing a radial pattern of light to illuminate said curtain of liquid droplets, said light directing means being positioned near the region of said liquid droplet curtain so that said radial pattern of light is projected substantially vertically into said curtain of liquid droplets.

* * * * *